US006572297B2

(12) United States Patent
Korper

(10) Patent No.: US 6,572,297 B2
(45) Date of Patent: Jun. 3, 2003

(54) PRESSURE MODULATED FREE INK MARKER FOR PRODUCING VARIABLE LINE WIDTH

(76) Inventor: George W. Korper, 13950 Kennard Dr., Glenelg, MD (US) 21737

( * ) Notice: Subject to any disclaimer, the term of this patent is extended or adjusted under 35 U.S.C. 154(b) by 0 days.

(21) Appl. No.: 10/136,470

(22) Filed: May 2, 2002

(65) Prior Publication Data

US 2002/0192010 A1 Dec. 19, 2002

Related U.S. Application Data

(63) Continuation-in-part of application No. 09/951,526, filed on Sep. 14, 2001, now Pat. No. 6,488,429.

(51) Int. Cl.[7] ..... B43K 5/04; B43K 5/18

(52) U.S. Cl. ..... 401/186; 401/183; 401/184; 401/185; 401/199; 401/205; 401/206

(58) Field of Search ..... 401/199, 198, 401/202, 205, 206, 186, 185, 184, 183

(56) References Cited

U.S. PATENT DOCUMENTS 3,972,629 A * 8/1976 Whalen, Jr. ..... 401/199
4,496,258 A * 1/1985 Tanaka et al. ..... 401/199 X
4,588,319 A * 5/1986 Niemeyer ..... 401/199 X
4,671,692 A * 6/1987 Inaba ..... 401/199
5,556,215 A * 9/1996 Hori ..... 401/199
5,687,886 A * 11/1997 Bolton ..... 222/630
5,964,931 A * 10/1999 Korper ..... 106/31.93

* cited by examiner

*Primary Examiner*—David J. Walczak
*Assistant Examiner*—Kathleen J. Prunner
(74) *Attorney, Agent, or Firm*—Edell, Shapiro & Finnan LLC

(57) ABSTRACT

A liquid marker system utilizes three primary components to permit marking of lines of various widths from a single nib. The three components are a porous nib, a transfer wick and a squeezable container. Operation relies on different squeeze pressures applied to the housing to produce different line widths from the single nib as the nib is moved across a marked surface. The porous wick provides a resistance to flow until the bottle is squeezed and then supplies a minimum of capillary flow to the nib. The user squeezes the container to overcome the resistance of the wick. No venting of the container interior is required because the wick and nib system allows the passage of air into the container when the container is returned to its unstressed (i.e., un-squeezed) condition.

21 Claims, 7 Drawing Sheets

PRESSURE MODULATED FREE INK MARKER FOR PRODUCING VARIABLE LINE WIDTH

CROSS-REFERENCE TO RELATED APPLICATIONS

This application is a continuation-in-part of U.S. patent application Ser. No. 09/951,526, filed Sep. 14, 2001, now U.S. Pat. No. 6,488,429 and entitled "Pressure Modulated Free Ink Marker For Producing Variable Line Width". The disclosure of the application is incorporated herein by reference in its entirety.

BACKGROUND OF THE INVENTION

1. Technical Field

The present invention pertains to improvements in liquid markers and more particularly, to free ink marker systems and methods utilizing pigments, paints, dyes, liquid chalk, etc.

2. Discussion of the Art

Various prior art markers permit marking fluids to be squeezed from a container through a porous nib; however, such markers have lacked the ability to control or modulate the delivery rate as required for detailed drawing, calligraphy, and other detail oriented applications. Moreover, squeeze containers are typically subject to leakage due to pressure variations and temperature changes. Other prior art marker designs utilize ink housed in absorbent fibers and transferred by capillary action to a porous nib.

Conventional liquid markers can only effect differing line widths by using a differently sized and/or configured nibs for each desired line.

OBJECTS AND SUMMARY OF THE INVENTION

It is an object of the invention to provide a liquid marker delivery method and apparatus in which the marker liquid can be squeezed from a container in a manner that permits close control over the delivery rate of the liquid.

It is another object of the invention to provide a liquid marker delivery method and apparatus capable of producing different line widths and effects with a single nib.

The aforesaid objects are achieved individually and in combination, and it is not intended that the present invention be construed as requiring two or more of the objects to be combined unless expressly required by the claims attached hereto.

In accordance with the present invention, a hand-held marker system utilizes three primary components to permit the marker to produce lines of various widths from a single nib. The three primary components are a porous nib, a transfer wick and a human hand squeezably compressible container or housing in which the wick and nib are disposed with the nib protruding from one end thereof. Stated otherwise, the present invention combines a porous wick utilized in conjunction with a squeezable plastic tube or bottle and a porous plastic or felt nib. System operation relies on different squeeze pressures applied to the housing to produce different line widths from the single nib. Squeeze bottles without a wick are subject to leakage due to pressure variations and temperature changes. The porous wick of the present invention provides a resistance to flow until the bottle is squeezed and then supplies a minimum of capillary flow to the nib. The user squeezes the container to overcome the resistance of the wick, and can supply marker fluid to the nib at volumes directly related to the squeeze pressure. As used herein the terms "wick" and "wick member" refer to a device capable of drawing liquid along surfaces thereof (i.e., by virtue of the very nature of its material and the nature of the liquid), or through one or more capillary orifices defined through the member, to provide the liquid delivery requirements described herein.

The simple device of the present invention requires no venting to atmosphere of the container interior because the wick and nib system allows the passage of air into the container. Specifically, when the container is returned to its unstressed (i.e., unsqueezed) condition, ambient air is aspirated back into the container through the nibwick system.

The squeeze pressure required to emit marker fluid from the container interior is set to be greater than any atmospheric differential pressure that would normally be experienced in the use of the marker system. In this manner, the marker system operates properly in airplanes, at different ground elevations, etc., without leaking due to pressure differentials.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF THE INVENTION

Figure 1:
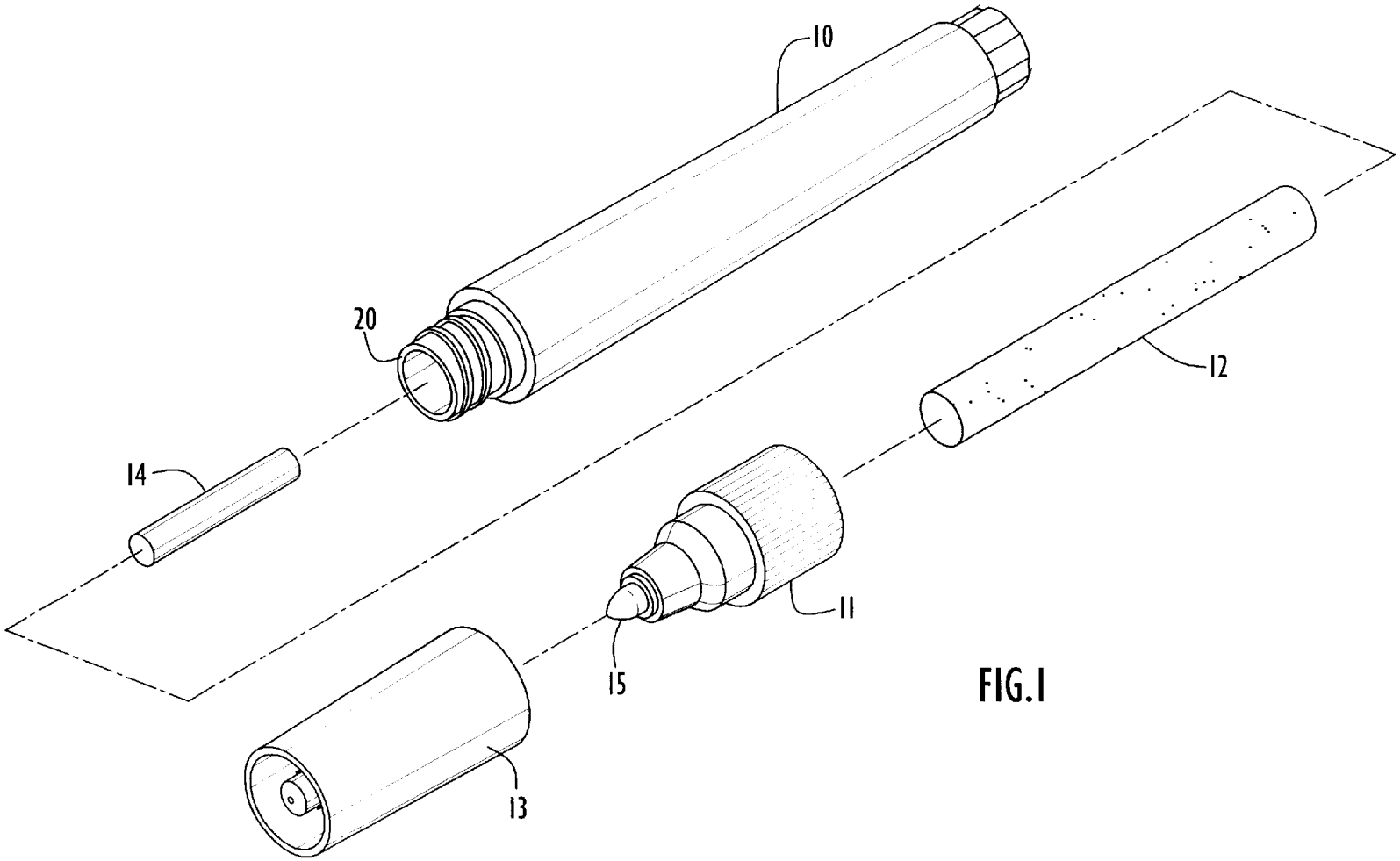
FIG. 1 is an exploded view in perspective of a preferred embodiment of the marker system of the present invention.
Figure 2:
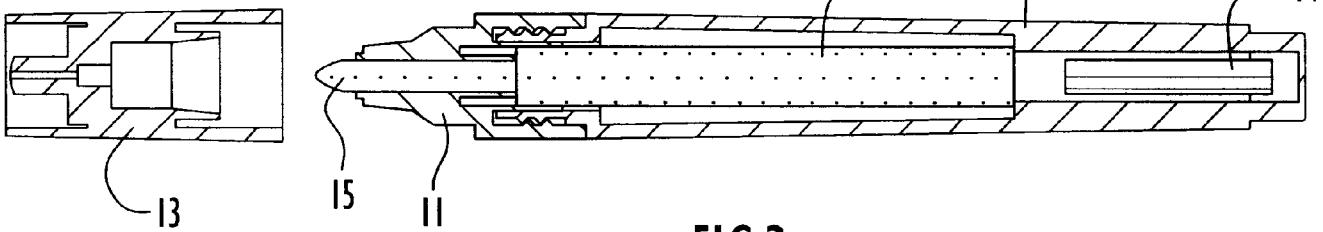
FIG. 2 is a view in longitudinal section of the embodiment of FIG. 1.

Referring to FIGS. 1 and 2, a marker system constructed in accordance with the present invention includes a housing adapted to be hand-held, defining an enclosed volume containing the marker liquid and comprising a hollow barrel 10 having an externally threaded distal end 20 to which an internally threaded end piece 11 is threadedly engaged and secured. End piece 11 retains or secures a nib 15 to the housing 10. The housing 10 has a resilient sidewall which forms a means to selectively pressurize the enclosed volume. The interior of end piece 11 is hollow and communicates with the hollow interior of barrel 10. Projecting from the forward end of end piece 11 and housing 10 is a tip of a porous marker nib 15, the rearward portion of which extends into the hollow interior of end piece 11. Nib 15 is made of conventional porous material of the type typically used in marker devices and is configured as a solid cylinder with a tapered distal tip. The taper is preferably gradual such that the tip appears more parabolic than conical.

A transfer means in the form of a generally cylindrical fibrous filler member or transfer wick 12 is disposed within the housing with its leading end preferably in contact with the rearward end of nib 15. A mixing slug or agitator 14 may optionally be disposed within the housing to facilitate mixing of marker fluid disposed in the reservoir formed by the housing. Specifically, shaking the housing causes slug 14 to mix the fluid in the reservoir.

Figure 3:
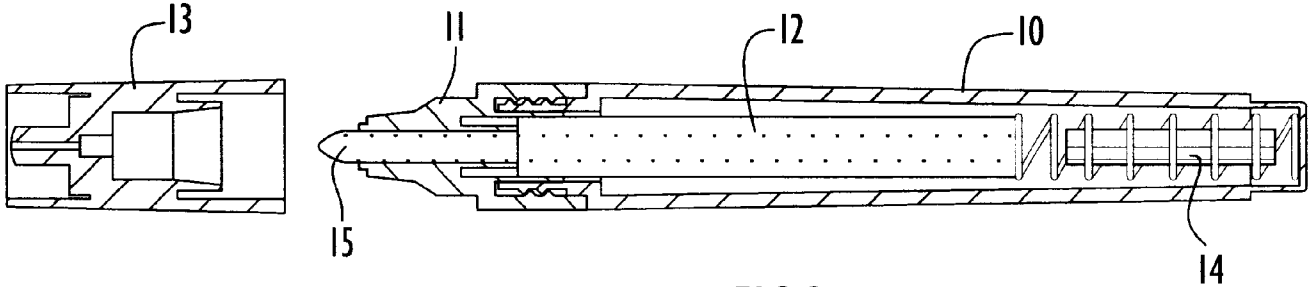
FIG. 3 is a view in longitudinal section of a modified version of the embodiment of FIG. 1.

A removable cap 13 can be secured by friction fit over the end piece 11 to cover nib 15 when the unit is not in use. Removal of cap 13 exposes the nib 15. As illustrated in FIG. 3, a helical spring may be disposed between the rearward end of transfer wick 12 and the interior surface of the proximal end wall of barrel 10 to urge the wick into biased longitudinal engagement with the rearward end of nib 15.

Figures 4, 5:
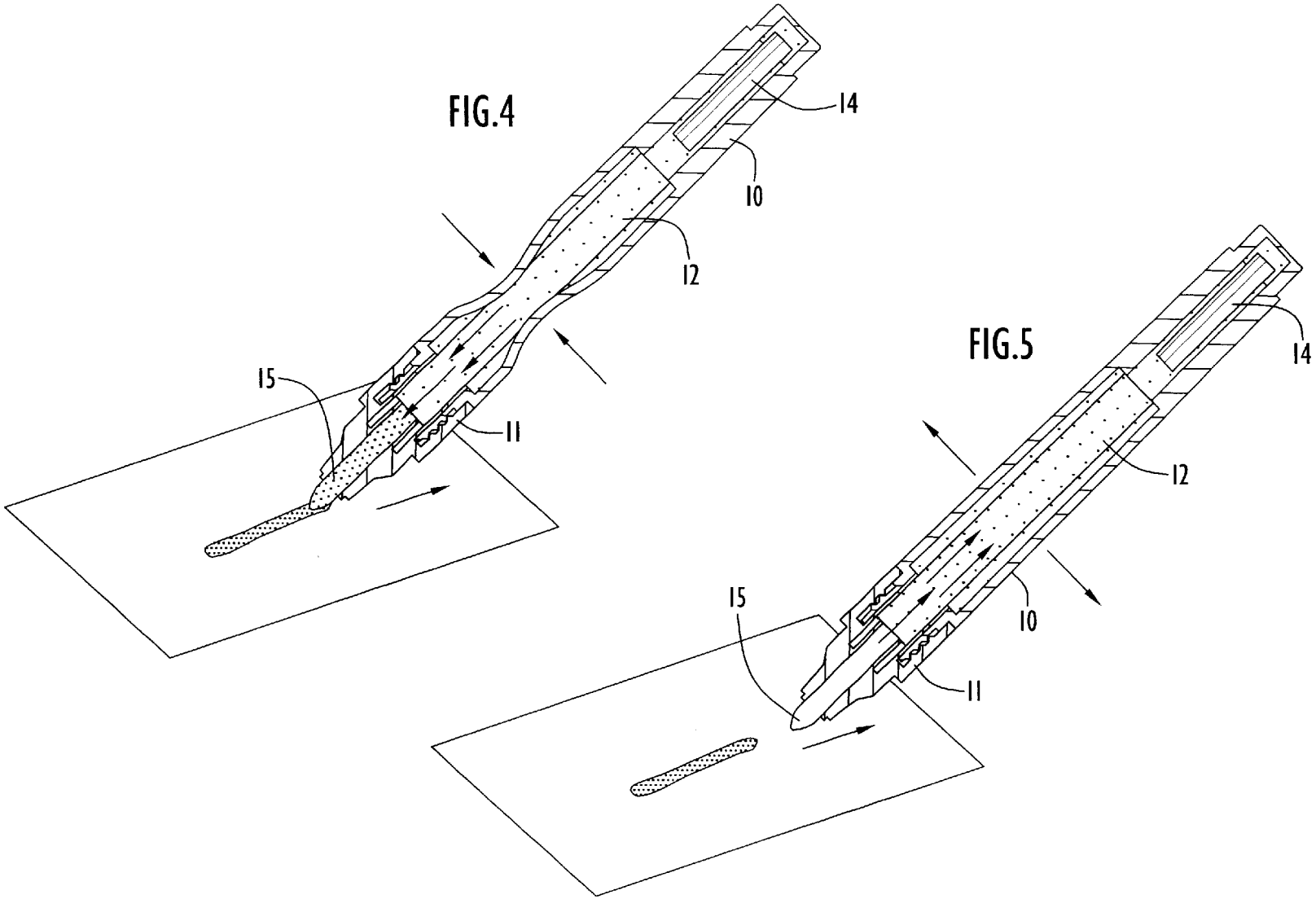
FIG. 4 is a view in perspective and longitudinal section of the embodiment of FIG. 1 shown during the delivery of marker fluid.
FIG. 5 is a view in perspective and longitudinal section of the embodiment of FIG. 1 shown immediately following the delivery of marker fluid.

As best illustrated in FIG. 4, with cap 13 removed, marker liquid may be forced out of the housing by squeezing the resilient sidewall of barrel 10 radially inward until the pressure created in the internal reservoir exceeds ambient atmospheric pressure at the exposed forward end of nib 15. Liquid disposed in and about wick 12 is forced through the porous nib and out through the forward end of end piece 11 onto a surface, such as a sheet of paper, at a flow rate dependent upon the applied pressure. This applied pressure, and hence the resulting flow rate of the marker liquid, determines the width of the line made by the nib as it traverses the marked surface. That is, the amount of liquid deposited at any point on the marked surface depends upon the speed of movement of the nib across the marked surface and the squeeze pressure induced flow rate of the liquid. The applied finger pressure on barrel 10 distorts the transfer wick 12 to the degree necessary to force liquid therefrom into and through the porous nib 15.

The porous transfer wick 12 provides resistance to flow of liquid therethrough sufficient to block the flow of a liquid in the absence of pressurization or a predetermined pressure drop distally across the transfer means. The wick 12 provides resistance to flow of liquid until the barrel 10 undergoes pressurization to at least the predetermined pressure drop or level above ambient pressure by being squeezed and then supplies a minimum of capillary flow to the nib. The user squeezes the barrel to overcome the resistance of the wick, permitting supply of marker fluid to the nib at volumes and flow rates directly related to the squeeze pressure.

As illustrated in FIG. 5, upon release of the finger pressure on barrel 10, a negative pressure (relative to the ambient atmosphere) is created within the reservoir as the barrel wall resiliently returns to its unstressed state. This negative pressure draws ambient air into the reservoir along with liquid disposed on and in the porous nib 15. Accordingly, marker fluid on or in the nib is drawn by suction back into the reservoir, thereby preventing leakage of the marker fluid after the finger pressure is removed from the barrel.

Figure 7A:
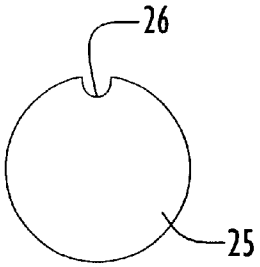
FIG. 7*a* is a view in transverse section of the nib employed in the embodiment of FIG. 7.
Figure 7B:
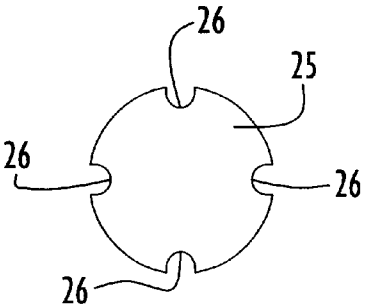
FIG. 7*b* is a view in transverse section of a nib having plural channels defined therein.
Figure 6:
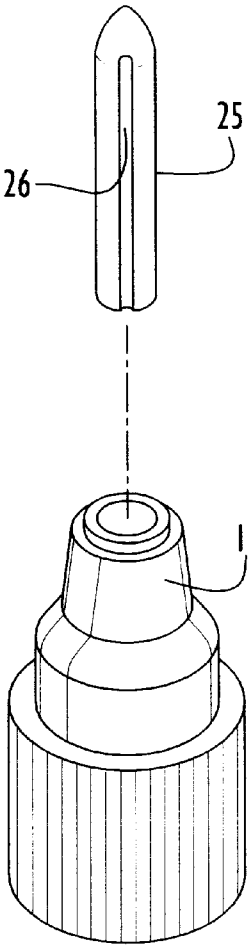
FIG. 6 is an exploded view in perspective of the distal end portion of another marker of the present invention incorporating a modified nib with a channel defined therein.

In order to aid in aspiration of ambient air upon release of finger pressure, it is desirable in some embodiments of the invention to provide porosity in the nib 15 in the form of a channel defined longitudinally along the nib periphery. One such embodiment is illustrated in FIGS. 6, 7*a* and 7*b*. Nib 25 is seen to have a shallow channel 26 extending longitudinally along the cylindrical portion of the nib, stopping short of the tapered distal tip. Channel 26 conducts ambient air into the reservoir when a negative pressure (relative to ambient) is created therein when the squeezing force is removed from the barrel. If desired, a plurality of longitudinal channels 26 may be defined in the nib periphery as illustrated in FIG. 7*b*.

Figure 8:
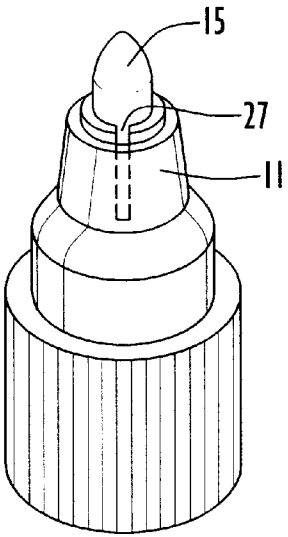
FIG. 8 is a view in perspective of the distal end portion of another marker of the present invention incorporating a channel in the housing portion surrounding the nib.

It is also possible to provide the aspiration-assisting channels in the housing portion surrounding or engaging the nib rather than in the nib itself. An example of this may be seen in the embodiment of FIG. 8 wherein a longitudinally extending bore or channel 27 is defined in the interior surface of end piece 11.

Figure 12:
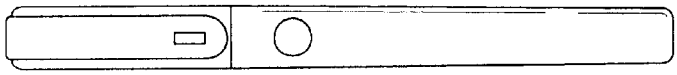
FIG. 12 is a side view in elevation of another marker embodiment of the present invention in which the housing is in the form of a pocket pen having a squeeze button actuator to control marker fluid outflow.
Figure 11:
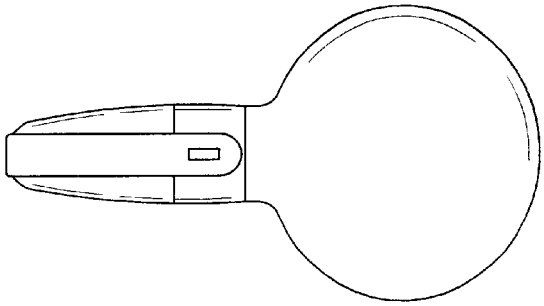
FIG. 11 is a side view in elevation of another marker embodiment of the present invention in which the housing is a squeeze bottle having flattened sides.
Figure 10:
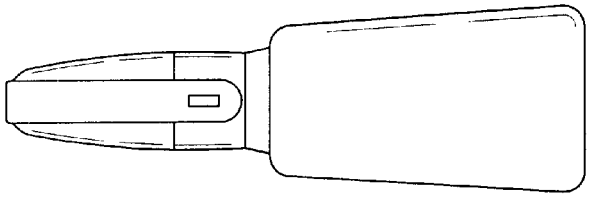
FIG. 10 is a side view in elevation of another marker embodiment of the present invention in which the housing is a squeeze bottle.
Figure 9:
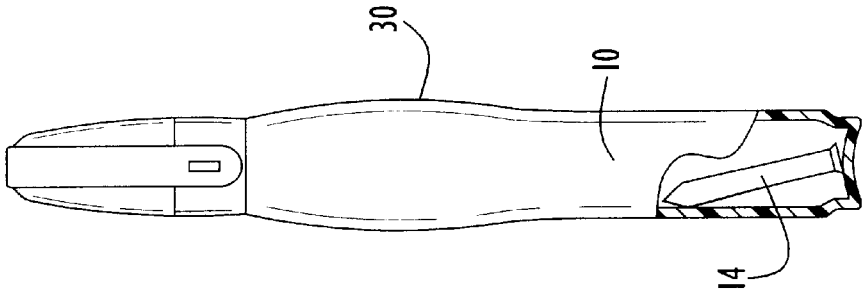
FIG. 9 is a side view in elevation of another marker embodiment of the present invention in which the housing is widened to facilitate control of fluid outflow.

Referring to FIG. 9, the squeezable barrel 10 is preferably formed of a material that is resiliently squeezable along the entire length of the housing and may be configured with an outwardly convex bulbous portion or bulge 30 that is squeezably compressible to provide a greater range of squeeze distance and more control over the delivery of marker liquid. The "barrel" may also take the form of a smaller cylindrical or slightly frusto-conical squeeze bottle (FIG. 10), or a generally circular or elliptical squeeze bottle having flat sides (FIG. 11). Alternatively, the barrel may have only a small portion or localized squeezable area, or section or squeezable button to pressurize the barrel interior as shown in FIG. 12.

The wick member 12 in the embodiment of FIG. 1 is made from materials commonly used for this purpose, such as felt, porous thermoplastic material, fibrous material, etc. The material, by its nature, "wicks" or draws the marker liquid by capillary action along the material surface to the nib. The wicking function is well known and is described, for example, in U.S. Pat. No. 3,972,629 (Whalen), the entire disclosure of which is incorporated herein by reference. For purposes of the present invention, and as illustrated in FIGS.

Figure 13:
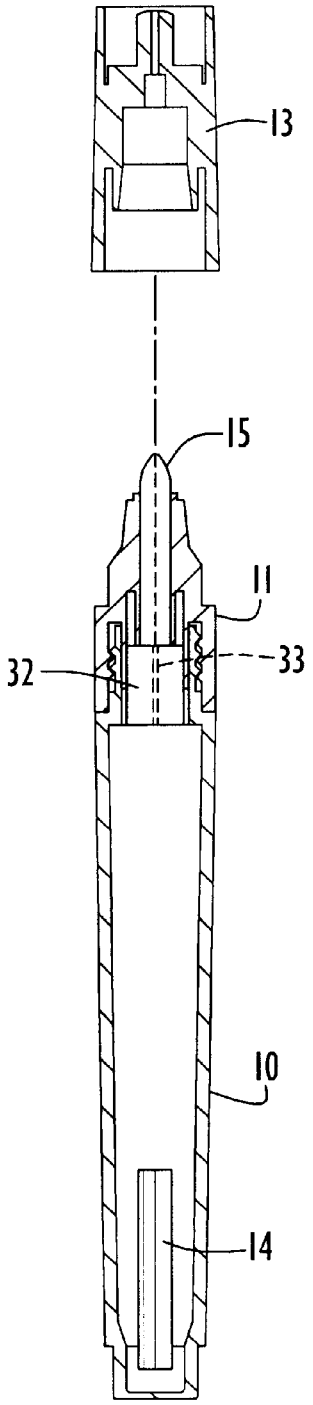
FIG. 13 is an exploded side view of another marker embodiment of the present invention in which the wicking function is provided by a capillary orifice extending through the wick member.
Figure 14:
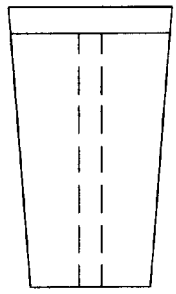
FIG. 14 is a side view in longitudinal section of the wick member used in the embodiment of FIG. 13.
Figure 15:
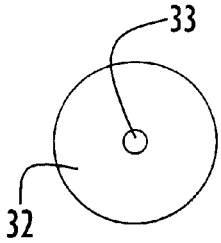
FIG. 15 is a top view in plan of the wick member of FIG. 14.
Figure 16:
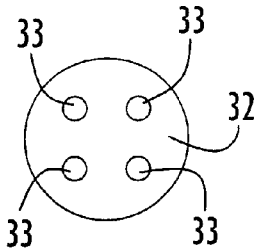
FIG. 16 is a top view in plan of a modified wick member having plural capillary orifices.

13 through 16, the wicking function may also be effected by providing one or more narrow orifices or capillaries extending longitudinally through a solid body "wicking" member. The orifices serve the wicking function due to the surface tension on the liquid created in the narrow orifice. The wicking member 32 shown in FIGS. 13–15 is made of any suitable material that is not itself "wicking" and is provided with a narrow capillary orifice 33 defined longitudinally therethrough. Member 32 is substantially shorter than wick 12, and functions in response to pressurization of the interior of barrel 10 by conducting liquid to the nib 15. Member 32 is retained in end piece 11 proximally (i.e., immediately rearward) of nib. The distal end of member 32 abuts the proximal end of nib 15 at the egress end of orifice 33, whereby the "wicked" liquid is directed into the porous nib. As shown in FIG. 16, wicking member may be provided with a plurality of capillary orifices.

Figure 17:
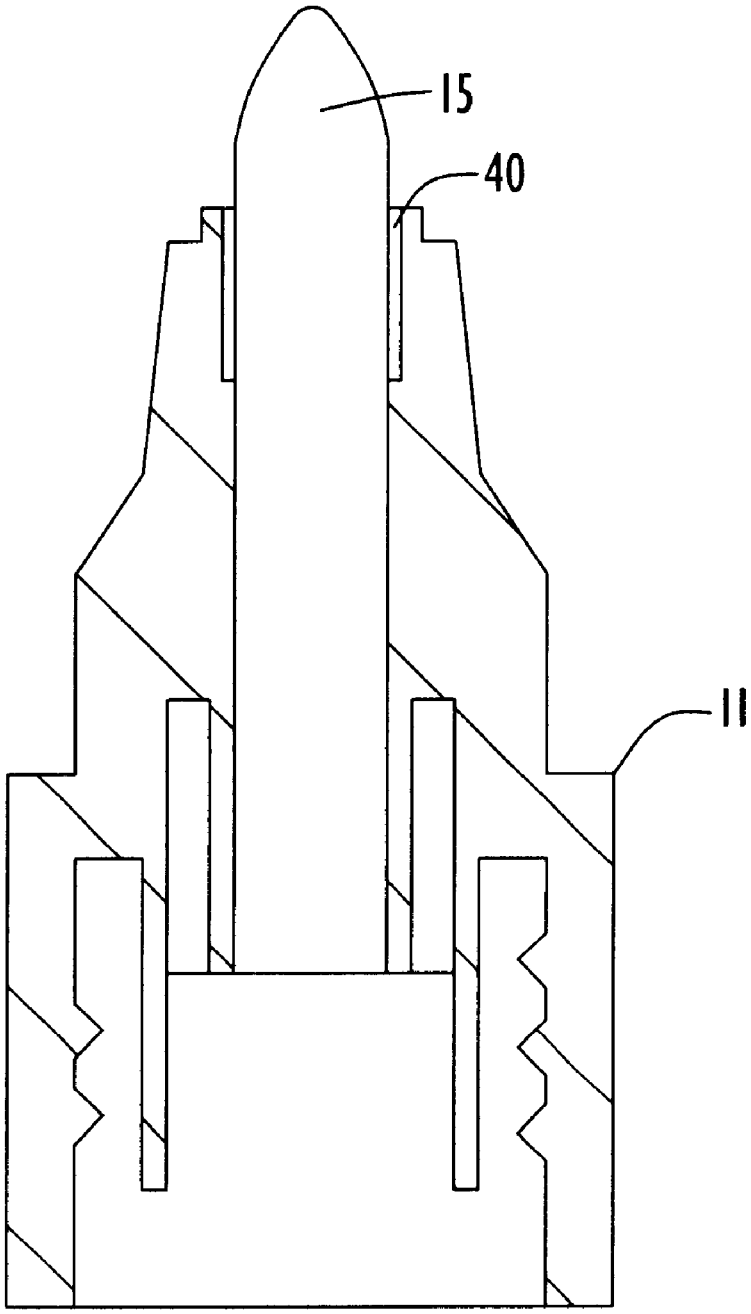
FIG. 17 is a side view in elevation of a modified end piece according to another embodiment of the invention.

A further possible modification of the present invention is to provide a slightly enlarged diameter section in the forward or downstream end of the nib-retaining bore defined in the end piece or nib holder 11 as, for example, illustrated in FIG. 17. The resulting narrow annular space 40 surrounding the forward end of the nib 15 serves a number of functions. First, instead of or in conjunction with the channels 26, 27 described above, the annular space 40 aids in aspiration of air into the marker fluid reservoir if a lower than ambient pressure is created in the barrel after the squeezing force is removed. In addition, if a lower than ambient pressure is created immediately surrounding the forward end of the nib (as, for example, when the cap is quickly removed), the annular space 40 functions as a mini-reservoir to receive marker fluid from the nib to prevent the fluid from exploding outwardly. The annular space is sufficiently small to permit marker fluid to be retained therein by surface tension rather than dripping along the nib. The annular space typically occupies one-third to one-half of the length of the nib-retaining bore, but may be longer or shorter to meet the requirements of different applications. The diameter of the annular space depends partly on the diameter of the nib and is typically five to twenty-five percent of the nib diameter.

The marker system described is applicable to all sorts of liquid pigments, paints, dyes, liquid chalks, etc., so that it can be used for a variety of applications, including lettering, painting, drawing, calligraphy, etc. The invention is the utmost in simplicity in requiring only three basic elements, namely the porous nib, the transfer wick and the squeezable reservoir. The reservoir may be in the form of a marker device as shown, a bottle, or any other form and shape consistent with the end use of the device.

The invention is highly advantageous in that it operates in an on/off manner with regard to liquid flow so that there is no dripping or spillage, no matter the orientation of the marker.

It should be understood that the principles of the present invention are adaptable for use with selective pressurization means other than a squeezable barrel. For example, selective pressurization of the marker fluid reservoir can be effected by the user blowing through a suitable mouthpiece provided in the manner described and illustrated in U.S. Pat. No. 5,687,886 (Bolton) the entire disclosure of which is incorporated herein by reference. Specifically, according to the disclosure in the Bolton patent a hollow tubular housing contains a fluid reservoir and a projecting nib. The apparatus has at its end remote from the nib a mouth piece through which air can be blown into the housing. The mouthpiece may be releasably secured to the housing and its position on the housing may be varied to accommodate markers of different length. Alternatively, the mouthpiece may be formed integrally with the housing.

Having described preferred embodiments of new and improved liquid marker delivery method and apparatus, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A marker system for delivering marker liquid to a surface to be marked, said system comprising:

a housing adapted to be hand-held and defining an enclosed volume containing the marker liquid, said housing having a distal end;

a porous marker nib secured to said housing and having a tip projecting from said distal end of said housing; and transfer means disposed within said housing for providing resistance to flow of liquid therethrough, said resistance being sufficient to block said flow in the absence of a predetermined pressure drop distally across said transfer means, but delivering capillary flow of the contained marker liquid from said enclosed volume to said nib in response to pressurization of said enclosed volume equal to at least said predetermined pressure drop above ambient pressure; and means for selectively pressurizing said enclosed volume.

2. The system of claim 1 wherein said housing is at least partially resiliently squeezably compressible by a human hand in which the housing is held to permit said selective pressurization of said enclosed volume.

3. The system of claim 2 wherein the entirety of said housing comprises a resiliently squeezable material.

4. The system of claim 2 wherein said housing is squeezably compressible only at a localized section of the housing.

5. The system of claim 1 wherein said transfer means comprises a wick of porous material abutting said nib.

6. The system of claim 5 wherein said housing is elongated and generally cylindrical and is comprised of a material that is resiliently squeezable along the entire length of the housing.

7. The system of claim 5 wherein said housing is elongated and generally cylindrical with a bulbous outwardly convex portion that is resiliently squeezably compressible.

8. The system of claim 5 wherein said housing is elongated and generally cylindrical with only a small portion of said housing being resiliently compressible.

9. The system of claim 1 wherein said transfer means comprises a solid body having at least one capillary passage defined longitudinally therethough in communication between said enclosed volume and said nib.

10. The system of claim 9 wherein said housing is elongated and generally cylindrical and is comprised of a material that is resiliently squeezable along the entire length of the housing.

11. The system of claim 9 wherein said housing is elongated and generally cylindrical with a bulbous outwardly convex portion that is resiliently squeezably compressible.

12. The system of claim 9 wherein said housing is elongated and generally cylindrical with only a small portion of said housing being resiliently compressible.

13. The system of claim 1 wherein said transfer means comprises a solid body having a plurality of capillary passages defined longitudinally therethough in communication between said enclosed volume and said nib.

14. The system of claim 13 wherein said aspiration means comprises porosity in said nib.

15. The system of claim 1 further comprising aspiration means for permitting entry of ambient air into said enclosed volume in response to the pressure in said enclosed volume dropping below ambient pressure.

16. The system of claim 15 wherein said aspiration means comprises a channel defined in the periphery of said nib.

17. The system of claim 15 wherein said aspiration means comprises a channel defined in a portion of the housing surrounding said nib.

18. The system of claim 15 wherein said aspiration means comprises a longitudinally extending bore defined in an interior surface of an end piece securing the nib to the housing.

19. A method of providing controllable delivery of marker liquid to a surface to be marked, said method comprising the steps of:

(a) disposing the marking fluid in a selectively pressurizable container defining an enclosed volume;

(b) securing a porous nib to a distal end of said container;

(c) resistively blocking flow of the marker liquid to said porous nib in the absence of pressurization of said enclosed volume to a predetermined level above ambient pressure; and (d) in response to pressurizing said enclosed volume to said predetermined level, delivering capillary flow of the contained marker liquid from said enclosed volume to said nib.

20. The method of claim 19 wherein step (a) comprises disposing the marker fluid in a squeezably compressible container to permit pressurizing of the enclosed volume to be effected by squeezing the container.

21. The method of claim 20 wherein pressurization of the enclosed volume is effected by a user blowing into the container.

* * * * *